US007370732B2

(12) United States Patent
Richter et al.

(10) Patent No.: US 7,370,732 B2
(45) Date of Patent: May 13, 2008

(54) METHOD AND DEVICE FOR AUTOMATIC CHECKING OF THE AVAILABILITY OF AN ELEVATOR INSTALLATION

(75) Inventors: Lutz Richter, Berlin (DE); Kllian Schuster, Ballwil (CH); Paul Friedli, Remetschwil (CH)

(73) Assignee: Inventio AG, Hergiswill NW (CH)

( * ) Notice: Subject to any disclaimer, the term of this patent is extended or adjusted under 35 U.S.C. 154(b) by 626 days.

(21) Appl. No.: 11/070,610

(22) Filed: Mar. 2, 2005

(65) Prior Publication Data

US 2005/0241887 A1 Nov. 3, 2005

(30) Foreign Application Priority Data

May 3, 2004 (EP) ..... 04405130

(51) Int. Cl.
*B66B 1/34* (2006.01)

(52) U.S. Cl. ..... 187/391; 187/380; 187/386

(58) Field of Classification Search ..... 187/380–388, 187/391–394

See application file for complete search history.

(56) References Cited

U.S. PATENT DOCUMENTS 3,973,648 A 8/1976 Hummert et al.
4,397,377 A * 8/1983 Husson et al. ..... 187/382
4,568,909 A 2/1986 Whynacht
5,388,668 A * 2/1995 Powell et al. ..... 187/387
5,892,190 A * 4/1999 Morita et al. ..... 187/382
6,328,134 B1 * 12/2001 Hikita ..... 187/382

FOREIGN PATENT DOCUMENTS

EP 0 364 151 4/1980
WO WO03/066497 8/2003

* cited by examiner

*Primary Examiner*—Jonathan Salata
(74) *Attorney, Agent, or Firm*—Fraser Clemens Martin & Miller LLC; William J. Clemens

(57) ABSTRACT

A method for automatic checking of the availability of an elevator installation having at least one elevator ascertains at least one first estimated value for a use frequency of the elevator for a first time period and/or a second estimated value for the use frequency for a second time period that begins later than the first time period. A measurement value for the use frequency for the first time period is determined and the measurement value compared with at least one of the estimated values. If the measurement value is smaller by a predetermined amount, at least one predetermined command for carrying out at least one test of the elevator installation is given, wherein in the case of availability of the elevator installation the test leads to a desired reaction. Subsequently, at least one reaction of the elevator installation is registered and compared with the desired reaction.

11 Claims, 5 Drawing Sheets

METHOD AND DEVICE FOR AUTOMATIC CHECKING OF THE AVAILABILITY OF AN ELEVATOR INSTALLATION

BACKGROUND OF THE INVENTION

The present invention relates to a method of automatic checking of the availability of an elevator installation with at least one elevator, and to a device for automatic checking of the availability of an elevator installation with at least one elevator.

It is in the interest of an operator of an elevator installation to keep the elevator installation in a state which ensures for the user of the installation a highest possible degree of availability. Since operational disturbances can prejudice the availability of the elevator installation and, in addition, represent a safety risk for users, it is of interest for the operator of the elevator installation for operating disturbances to be recognized as early as possible and, in a given case, the causes thereof established.

An elevator installation with a communications interface for communication with a remote maintenance center is disclosed in U.S. Pat. No. 3,973,648. A communications connection between a test system and an elevator control of the elevator installation can be produced by the remote maintenance center by way of the communications interface of the elevator installation. The test system is programmable in such a manner that at a predetermined point in time it produces a communications connection with the elevator control and automatically transmits car and/or floor calls in accordance with a predetermined program to the elevator control and analyses the respective reaction of the elevator installation. The analysis of the reactions accordingly supplies information about whether the elevator installation is instantaneously available. The procedure disclosed in the U.S. Pat. No. 3,973,648 has various disadvantages. For example, the availability of the elevator installation can be verified only at points in time which the personnel in the remote maintenance center planned or at points in time which are pre-programmed. The test system shall be used when the elevator installation is not in use, for example at night. Data about the availability of the elevator installation during the times in which persons normally use the elevator installation are not obtained in this way. Operational disturbances during the principal times of use of the elevator installation are accordingly not automatically detected without further measures. A further disadvantage is that the described tests only allow a reliable statement about the availability of the elevator installation when the tests embrace all possible journeys of an elevator installation between any floors. Accordingly, the tests lead to a large number of test travels of the elevator at times in which the elevator is not normally used by persons. In addition, several elevator installations are normally connected with a remote maintenance center. This concept usually excludes communication connections with the individual elevator installations being able to be maintained over a time period of any desired length. An individual elevator installation is accordingly usually not checkable by a remote maintenance installation without interruption.

SUMMARY OF THE INVENTION

The method and device according to the present invention address the above-stated disadvantages. The invention has the object of creating a method for automatic checking of the availability of an elevator installation which is suitable for rapidly establishing an impairment of the availability of the elevator installation during any time period with a smallest number possible of tests, particularly when the elevator installation is being used by passengers. Moreover, the invention shall provide a device suitable for carrying out such a method.

In the case of the method according to the present invention an automatic checking of the availability of an elevator installation with at least one elevator is realized in that the elevator installation is given at least one predetermined command for carrying out at least one test of the elevator installation and subsequently at least one reaction of the elevator installation is registered and compared with a desired reaction of the elevator installation. In the case of availability of the elevator installation the test should produce the desired reaction, i.e. the registered reaction should correspond with the desired reaction.

Whether, or in a given case when, the command for carrying out the test is given is, according to the present invention, determined as follows: A first estimated value for a use frequency of the elevator for a first time period is ascertained and/or a second estimated value for the use frequency for a second time period is ascertained, wherein the second time period begins at a later point in time than the first time period. Moreover, a measurement value for the use frequency for the first time period is determined and the measurement value is compared with at least one of the estimated values. Subsequently, the command is given if the measurement value is smaller than the respective estimated value by a predetermined amount.

If the registered reaction corresponds with the desired reaction, it can then be assumed that the elevator is available. If the registered reaction does not correspond with the desired reaction, then it can be assumed that the elevator is not available.

By "use" there shall be understood in this connection any service of the elevator of benefit to a user. As a rule a use is connected with a car call, a floor call, a travel command and/or a command for opening or closing of a door or several doors.

The term "use frequency" shall in this connection denote any quantitative measurement for the frequency of use, wherein it is presupposed that the use frequency is greater the more frequently use takes place. For example, it is possible to determine a use frequency as the number of uses taking place in a predetermined time period. Alternatively, it is also possible to derive a use frequency from a length of a time period which extends from a predetermined point in time to the point in time of the next use, wherein the use frequency could be determined as the reciprocal value of the time period. For example, a use frequency could be determined as the reciprocal value of the spacing in time between two successive uses.

The present invention in that case proceeds from the idea that the fact that an elevator is just used is usually evidence that the elevator is available. A cause for checking the availability by means of a test is therefore seen during operation of an elevator only:

when the use frequency measured in operation is smaller than expected (in this case an operational disturbance could be present); or when an increase in the use frequency by a predetermined amount is expected (in this case it is checked before the expected rise in the use frequency whether the elevator is available in order in a given case—if the elevator should not be available—to be able to reinstate the availability of the elevator by suitable measures in good time before the increase).

An estimated value for the use frequency of the elevator for a predetermined period of time can be ascertained, for example, in that initially before this period of time uses of the elevator and the points in time of the respective uses are registered. In a further step, on the basis of plausible assumptions about the development over time of the use frequency from the already registered points in time of the uses it can be determined which use frequency for the predetermined period of time can be expected. This expected use frequency would be regarded in this connection as the aforesaid mentioned estimated value.

Assumptions about the development over time of the use frequency can be taken on the basis of a use model, i.e. on the basis of a theoretical model for uses of the elevator. In the context of the invention a use model can be suitably selected according to the respective situation.

For an elevator in a publicly accessible building, a use model could be obtained on the basis of, for example, a statistical analysis of uses. A statistical analysis can show, for example, that the use frequency follows specific trends in accordance with expectation in dependence on a series of parameters, for example as a function of the time in the course of a day, from day to day or from week to week, due to habits of the users or other influencing factors (opening times, holidays, weather, etc.). In addition, planned events can influence the course of the use frequency. Thus, functions in which a specific number of persons participate influence the frequency in characteristic manner during a defined time span. It can be expected, for example, that the use frequency at the beginning or end of such functions strongly increases and subsequently reduces again, wherein the size of the increase depends on the number of participating persons.

In other cases an elevator installation could be operated under conditions which constantly change and do not exhibit any long-term trends. In this case plausible assumptions about a development over time of the use frequency can be made on the basis of a use model which merely makes predictions about short-term trends. For example, the change over time of the use frequency can be measured over a first time period and subsequently the time behavior of the use frequency during a second time period following the first time period can be estimated by extrapolation of the values, which are measured during the first time period, for the use frequency. The extrapolation is based on the assumption that a correlation exists between the time course of the use frequency in the first time period and the time course of the use frequency in the second time period. If, for example, the use frequency in a first time period should steadily rise then it can be assumed that this trend continues at least over a specific time after the end of the first time period. If, on the other hand, the use frequency in a first time period should steadily diminish then it can be assumed that the use frequency further decreases by a specific amount at least over a specific time after the end of the first time period. In this manner measurement values for the use frequency for the first time period can be used in order to determine estimated values for the use frequency for a time span following the first time period.

In a further variant of the method according to the present invention it is proposed that for determination of a measurement value for the use frequency a duration of a time period is predetermined and a number of uses of the elevator registered during the time period is determined and the measurement value is calculated from the number and the duration (for example, as a quotient of the respective number and the predetermined duration). This variant of the method is particularly advantageous when use is made, as estimated values for the use frequency, of respective statistical data respectively determined for time periods with a predetermined duration.

In the case of an alternative to the afore-mentioned variant of the method it is proposed that for determination of a measurement value for the use frequency in each instance a number of uses of the elevator is predetermined and a duration of a time period in which these uses are registered is determined and the measurement value is calculated from the number of the duration (for example, as a quotient of the predetermined number and the respective duration). In the simplest case the predetermined number can be "1".

A further form of embodiment of the method according to the present invention comprises the method step stated in the following: a first estimated value for the use frequency and a measurement value for the use frequency are determined in each instance for a first time period and a second estimated value for a second time period following the first time period is set to a value which:

(i) is the same as the first estimated value if the first estimated value and the measurement value differ by not more than a predetermined amount; or (ii) is smaller than the first estimated value if the measurement value is smaller than the first estimated value by more than the predetermined amount; or (iii) is greater than the first estimated value if the measurement value is greater than the first estimated value by more than the predetermined amount.

These method steps can be carried out iteratively. In a first repetition of the method steps initially a measurement value for the use frequency for the second time period can be determined. Subsequently, according to one of the aforementioned method steps (i), (ii) or (iii) an estimated value for a further time period following the second time period can be determined, etc.

This form of embodiment of the method according to the present invention has several advantages.

The above steps (i), (ii) and (iii) can, for example, be realized in the form of a mathematical function which assigns to an estimated value and a measurement value of the use frequency for a predetermined time period a respective estimated value for a later time period. Such a mathematical function can be appropriately selected for the purpose of the method according to the present invention pursuant to various criteria. For one thing, the mathematical function defines a rule how an estimated value, which is required in the performance of the method, for the use frequency is to be calculated from the measurement values for the use frequency. The iteration of the aforesaid method steps accordingly enables performance of the method according to the present invention in such a manner that each estimated value which has to be known during performance of the method at a specific point in time can be calculated with use of the mathematical function successively from measurement values for the use frequency which was ascertained at an earlier point in time. Since the measurement values for the use frequency can change in the course of time in operation of the elevator, the estimated values, which are ascertained by means of the mathematical function, of the use frequency similarly change as a function of time. In performance of the method the respective estimated values for the use frequency are accordingly continuously adapted in dependence on measurement values for the use frequency. This adaptation contributes to the purpose of being able to keep the number of tests during performance of the method as small as possible. The mathematical function can be appropriately selected for optimization of the method.

In the case of a further form of embodiment of the method according to the present invention it is proposed that a reaction of the elevator installation and/or a use of the elevator is or are registered by means of registration of an actuation of a car door and/or of a shaft door and/or a registration of a change in the state of a drive of the elevator installation and/or a registration of an actuation of a brake and/or a registration of signals for control of components of the elevator installation and/or a detection of a position of a car of the elevator. In usual elevator installations, actuations of a car door or a shaft door and/or a change in a state of a drive of the elevator installation and/or actuations of a brake and/or signals for control of components of the elevator installation and/or a position of the car of the elevator are in any case detected by means of suitable sensors. Conventional elevator installations accordingly usually comprise sensors, the signals of which give information about the point in time of a use. The signals can be used for determination of measurement values for the use frequency of an elevator and thus form a basis for performance of the method according to the present invention.

The command for carrying out at least one test of the elevator installation can comprise, for example, a car call, a floor call and/or a travel command. Car calls, floor calls and/or travel commands can be produced in conventional elevators by relatively simple means. This is frequently possible without use of detailed data about the construction of an elevator control.

The desired reaction can comprise, for example, the following procedures: opening and closing of a floor door of the elevator installation and/or opening and closing of a car door and/or travel of a car from a predetermined floor to another predetermined floor. Processes of that kind are relatively simple to detect by means of sensors which are in any case present in conventional elevator installations.

According to the present invention, for performance of the described method for automatic checking of the availability of an elevator installation a device is suitable which comprises:

a command transmitter by which a predetermined command for carrying out at least one test of the elevator installation can be given to a elevator control for at least one elevator, wherein the test is so selected that in the case of availability of the elevator installation a desired reaction of the elevator installation can be registered;

a registration device for registering a reaction of the elevator installation following the command;

a device for comparing the reaction with the desired reaction;

a device for determining a first estimated value for a use frequency of the elevator for a first time period and/or for determining a second estimated value for the use frequency during a second time period;

a measuring device for ascertaining a measurement value for the use frequency for the first time period; and a control device for controlling the command transmitter in such a manner that the command is given when the measurement value is smaller than one of the estimated values by a predetermined amount.

The device according to the present invention can be installed, for example, in the vicinity of the elevator installation.

The device according to the present invention can be equipped with means for communication by way of a communications connection for transmission of predetermined information to a monitoring center for the case that the reaction does not correspond with the desired reaction. In case of need the device according to the present invention can automatically activate the communications connection with the monitoring center. If the situation should arise that the elevator installation is not available, attention can in this way be automatically given to assistance.

The method according to the present invention or the device according to the present invention offers further advantages:

The method leads to only one test of the elevator installation when observations of the operation deliver an indication that such a test could be useful at that moment (because the availability is instantaneously placed in question or, prior to an anticipated event, it necessarily has to be ensured that the elevator installation is available). In this manner it can be achieved that the number of tests is kept small and operational disturbances are rapidly recognized.

The device according to the present invention can usually be retrofitted in conventional installations without difficulties. This is possible, since car calls, floor calls and/or travel commands can be produced by simple means and uses of the elevator and reactions of the elevator such as, for example, opening and closing of a shaft door of the elevator installation and/or opening and closing of a car door and/or travel of a car can be registered by simple means.

The method according to the present invention is also suitable for checking the availability of the elevator installation with several elevators, which have a group control.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
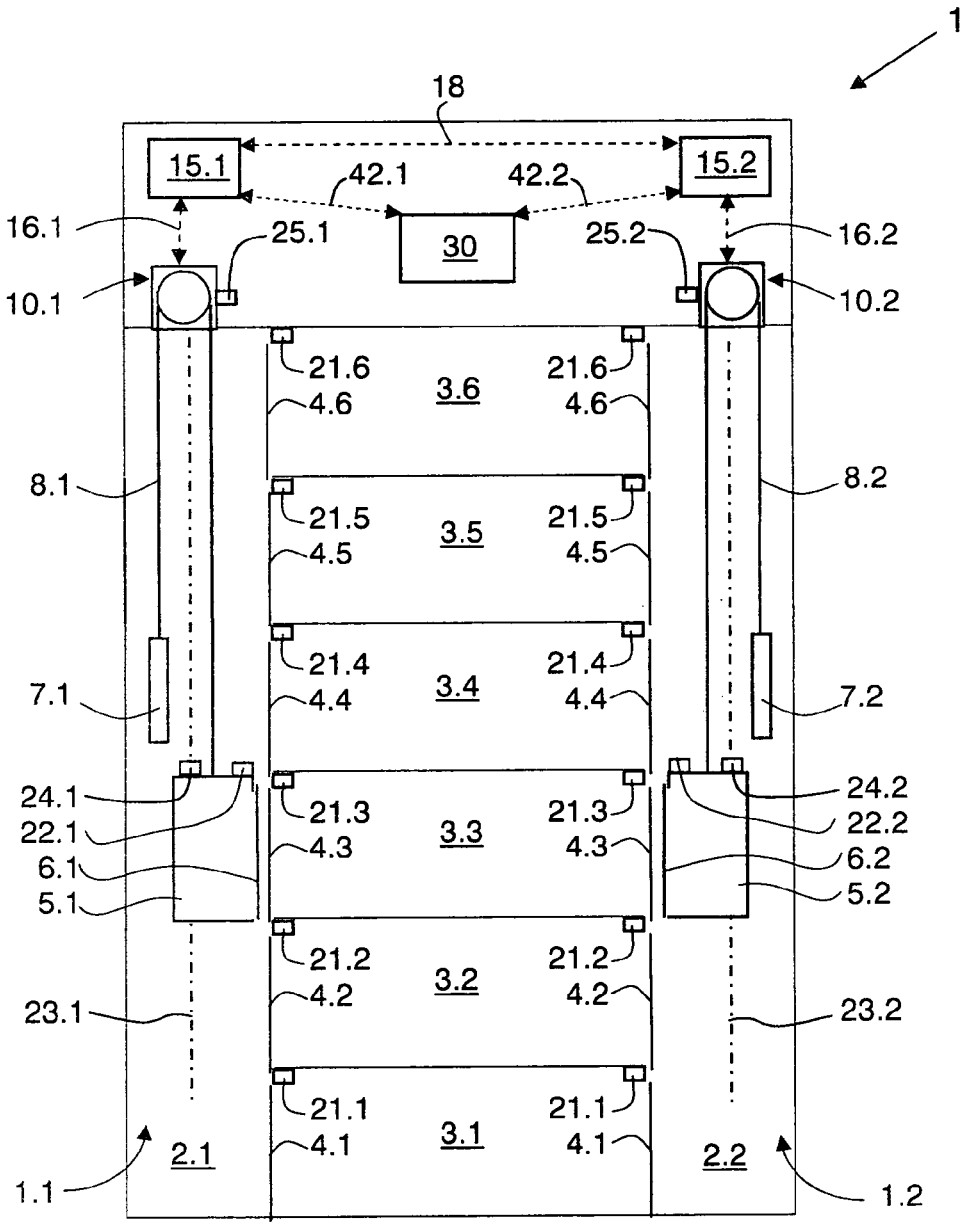
FIG. 1 is a schematic representation an elevator installation with two elevators and a device according to the present invention for automatic checking of the availability of the elevator installation.

FIG. 1 shows an elevator installation 1 with two elevators 1.1 and 1.2 of the same construction in conjunction with a device 30 according to the present invention for automatic checking of the availability of the elevator installation 1.

The elevator installation 1 is installed in a building with six floors 3.1, 3.2, 3.3, 3.4, 3.5 and 3.6. A respective shaft 2.1 or 2.2 is provided for each of the elevators 1.1 and 1.2, respectively. Two respective shaft doors 4.1 through 4.6 are disposed at each of the respective floors 3.1 through 3.6.

The elevator 1.1 comprises: a car 5.1 with a car door 6.1 at a side facing the floors 3.1 through 3.6, a counterweight 7.1, a support means 8.1 for the car 5.1 and the counterweight 7.1, a drive 10.1 with a drive pulley for the support means 8.1 and an elevator control 15.1. The car 5.1 and the counterweight 7.1 are connected together in each instance by way of the support means 8.1, wherein the support means 8.1 loops around the drive pulley of the drive 10.1. Activation of the drive 10.1 causes rotation of the drive pulley and thus movement of the car 5.1 and the counterweight 7.1 upwards and downwards in opposite sense. For control of the elevator 1.1 in operation, signals can be transmitted between the elevator control 15.1 and various controllable components of the elevator 1.1 by way of a communications connection 16.1.

The elevator 1.2 correspondingly comprises a car 5.2 with a car door 6.2 at a side facing the floors 3.1 through 3.6, a counterweight 7.2, a support means 8.2 for the car 5.2 and the counterweight 7.2, a drive 10.2 with a drive pulley for the support means 8.2 and an elevator control 15.2. The car 5.2 and the counterweight 7.2 are connected together in each instance by way of the support means 8.2, wherein the support means 8.2 loops around the drive pulley of the drive 10.2. Activation of the drive 10.2 causes rotation of the drive pulley and thus movement of the car 5.2 and the counterweight 7.2 upwards and downwards in opposite sense. For control of the elevator 1.2 in operation, signals can be transmitted between the elevator control 15.2 and various controllable components of the elevator 1.2 by way of a communications connection 16.2.

The elevators 1.1 and 1.2 can be controlled independently of one another by the elevator control 15.1 and 15.2, respectively. In addition, a communications connection 18 is provided between the elevator controls 15.1 and 15.2. Signals between the elevator controls 15.1 and 15.2 can be exchanged in case of need by way of the communications connection 18 in order to be able to operate the elevators 1.1 and 1.2 as an elevator group with a group control.

Figure 2:
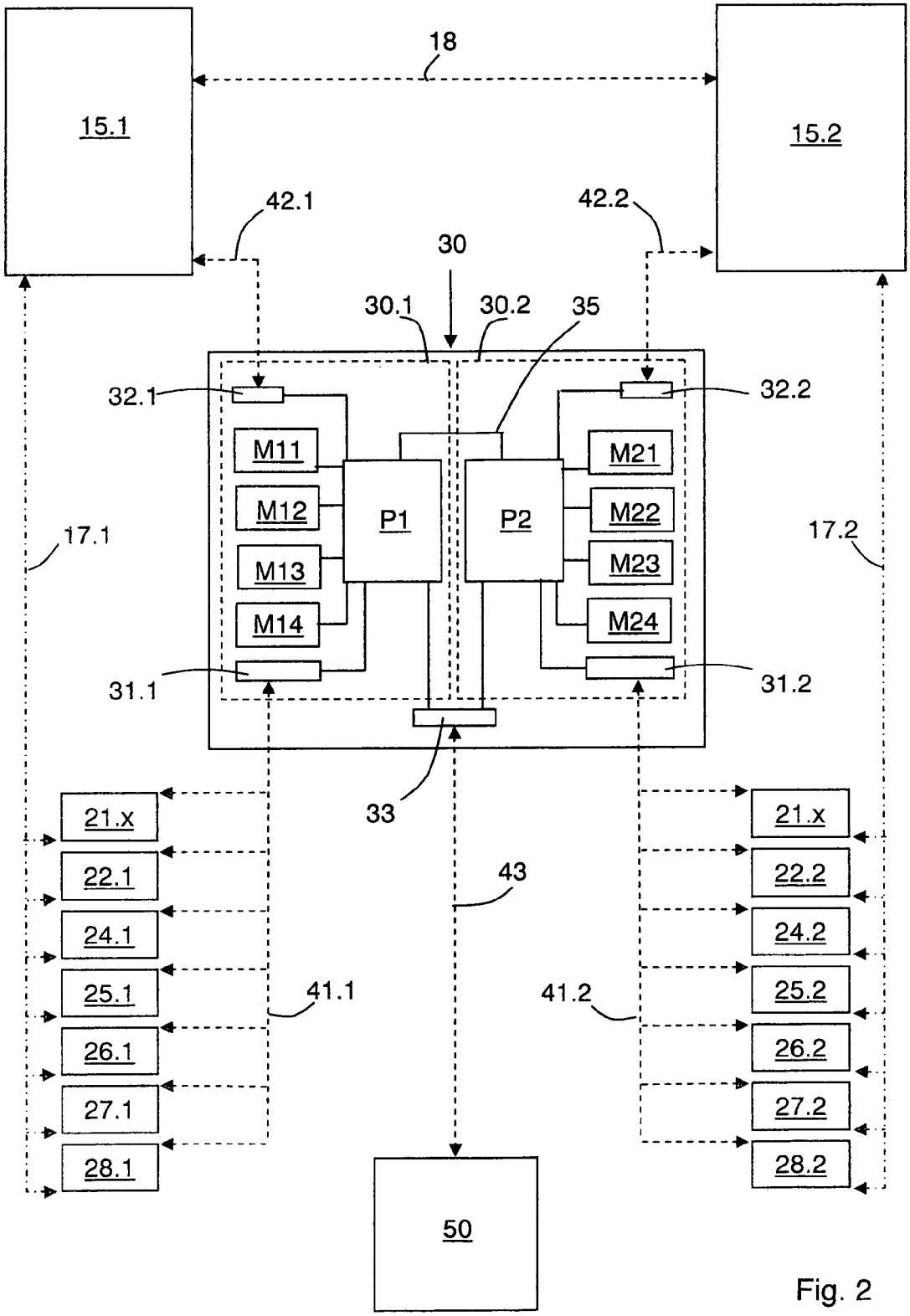
FIG. 2 is a block diagram of the device according to the present invention in accordance with FIG. 1 in detail.

The elevator installation 1 has—as indicated in FIGS. 1 and 2—a number of devices intended to detect different operational states of the elevator installation and in a given case to register changes in operational states:

devices 21.1, 21.2, 21.3, 21.4, 21.5, 21.6 (21.x) for monitoring and registering actuation of the respective shaft doors 4.1, 4.2, 4.3, 4.4, 4.5, 4.6;

devices 22.1 and 22.2 for monitoring the respective car doors 6.1 and 6.2 and for registering actuation of the car doors 6.1 and 6.2;

a coding means 23.1, which is arranged in the shaft 2.1, for a position of the car 5.1 and a device 24.1 arranged at the car 5.1 for reading the coding means 23.1 and for detection of the position of the car 5.1;

a coding means 23.2, which is arranged in the shaft 2.2, for a position of the car 5.2 and a device 24.2 arranged at the car 5.2 for reading the coding means 23.2 and for detecting the position of the car 5.2;

devices 25.1 and 25.2 for registering a state of the drives 10.1 and 10.2, respectively, and for registering a change in a state of the drives 10.1 and 10.2 (a state of the drive can be characterized by, for example, a current flow in the respective drive or a speed or an acceleration of components which are moved during the activation of the respective drive);

devices 26.1 and 26.2 for registering actuation of a brake of the elevators 1.1 and 1.2, respectively;

devices 27.1 and 27.2 for registering signals of the elevator controls 15.1 and 15.2, respectively (for control of the elevator installation); and devices 28.1 and 28.2 for registering persons in the vicinity of the elevator installation 1 or the elevators 1.1 and 1.2 respectively (for example, movement reporters, cameras, light barriers, etc.).

In the case of use of one of the elevators 1.1 and 1.2 usually at least one of the doors is moved and/or the position of one of the cars 5.1 and 5.2 changed and/or a state of one of the drives 10.1 and 10.2 changed and/or at least one signal of one of the elevator controls 15.1 and 15.2 produced. Moreover, use usually presupposes at least one person in the vicinity of the elevator installation 1.

In the case of use of one of the elevators 1.1 and 1.2, changes of operational states usually arise, which can be detected by one of the devices 21.x, 22.1, 22.2, 24.1, 24.2, 25.1, 25.2, 26.1, 26.2, 27.1, 27.2, 28.1, 28.2. These devices provide signals which characterize the respective operational state. Use of one of the elevators 1.1 and 1.2 can accordingly be registered with the help of one of the aforesaid devices. The signals of these devices can be detected by the elevator controls 15.1 and 15.2 via communications connections 17.1 and 17.2, respectively, as indicated in FIG. 2.

FIG. 2 shows details of the device 30. This comprises a device 30.1 for checking the availability of the elevator 1.1 and a device 30.2 for checking the availability of the elevator 1.2. The devices 30.1 and 30.2 are of substantially the same construction.

The device 30.1 comprises a processor P1 and different components with which the processor P1 can exchange data in operation:

a communications interface 31.1 for communication with the devices 21.x, 22.1, 24.1, 25.1, 26.1, 27.1, 28.1 by way of a communications connection 41.1;

a communications interface 32.1 for communication with the elevator control 15.1 by a communications connection 42.1;

a memory M11 for a program for checking availability of the elevator 1.1 (called "P1.1" in the following);

a memory M12 for estimated values for a use frequency of the elevator 1.1;

a memory M13 for measurement values for the use frequency of the elevator 1.1; and a memory M14 for data.

The program "P1.1" can run under the control of the processor P1. The program "P1.1" controls different processes:

a) Under the control of the program "P1.1", the processor P1 can evaluate signals of the devices 21.x, 22.1, 24.1, 25.1, 26.1, 27.1, 28.1;

b) The evaluation of the signals according to a) enables registration of uses of the elevator 1.1 and determination of measurement values for the use frequency of the elevator 1.1. The processor P1 accordingly forms together with at least one of the devices according to a) and the memory M11 a measuring device for the use frequency of the elevator 1.1. The measurement values for the use frequency can be registered as a function of time. The measurement values for the use frequency can be filed in the memory M13;

c) Under the control of the program "P1.1" the processor P1 can give commands which are communicated to the elevator control 15.1 by way of the communications connection 42.1, for example a command for carrying out a test of the elevator 1.1. The processor P1 accordingly forms together with the memory M11 a command transmitter for the elevator control 15.1;

d) Under the control of the program "P1.1" the processor P1 can register and evaluate the signals of the devices 21.x, 22.1, 24.1, 25.1, 26.1, 27.1, 28.1, which follow directly on the respective command according to c). The signals characterize a reaction of the elevator 1.1 to the respective command. The processor P1 accordingly forms together with at least one of the aforesaid devices and the memory M11 a registration device for reactions of the elevator 1.1;

e) Data which specify all possible desired reactions of the elevator 1.1 and are associated with each of the commands which can be given to the elevator control and produce the respective desired reactions can, for example, be stored in the memory M14. Under the control of the program "P1.1" the processor P1 can ascertain the corresponding desired reaction for the command given to the elevator control according to d) and compare a reaction registered according to d) with the desired reaction. The processor P1 accordingly forms together with the memories M11 and M14 a device for comparing a reaction with a desired reaction;

f) Estimated values for the use frequency of the elevator 1.1 can be filed in the memory M12. Estimated values for the use frequency for a specific period of time can be determined under the control of the program "P1.1" from, for example, measurement values for the use frequency according to methods which are explained in the following. Signals of the devices 28.1 and 28.2 can also be utilized for determination of estimated values for the use frequency. Signals of these devices give information about the number of persons who approach the elevator installation or go away from the elevator installation or stand in the vicinity of the elevator installation. If the number of persons registered by the devices 28.1 and 28.2 changes then it is to be expected that in the course of time the use frequency of the elevator will also change. If the devices 28.1 and 28.2 register a specific number of persons who approach the elevator installation 1 then it is to be expected that the use frequency will rise. If in this case, for example, a measurement value for the use frequency for a first time period is known, then an estimated value of the use frequency for a later time period can be calculated from the measurement value and the number of registered persons. The number of registered persons in this case establishes an upper limit for the use frequency in the second time period; and g) Under the control of the program "P1.1" the processor P1 can compare estimated values and measurement values for the use frequency and decide, in dependence on a result of the comparison, whether and in a given case when a command for carrying out a test of the elevator 1.1 according to c) shall be given.

Analogously to the construction of the device 30.1, the device 30.2 comprises a processor P2 and various components with which the processor P2 can exchange data in operation:

a communications interface 31.2 for communication with the devices 21.x, 22.2, 24.2, 25.2, 26.2, 27.2, 28.2 by way of a communications connection 41.2;

a communications interface 32.2 for communication with the elevator control 15.2 by a communications connection 42.2;

a memory M21 for a program for checking the availability of the elevator 1.2 (called "program P1.2" in the following);

a memory M22 for estimated values for a use frequency of the elevator 1.2;

a memory M23 for measurement values for the use frequency of the elevator 1.2; and a memory M24 for data.

The program "P1.2" can run under the control of the processor P2. The program "P1.1" and the program "P1.2" are equivalent. The statements with respect to the program "P1.1" according to the above points a)–g) correspondingly apply to the program "P1.2", wherein the functions of the communications interfaces 31.2 and 32.2 of the device 30.2 correspond with the respective functions of the communications interfaces 31.1 and 32.1 of the device 30.1. The functions of the memories M21, M22, M23, M24 of the device 30.2 correspond with the respective functions of the memories M11, M12, M13, M14.

The processors P1 and P2 can be connected together by way of a communications connection 35, as indicated in FIG. 2. Data can be exchanged between the processors P1 and P2 by way of the communications connection 35. This is useful if the elevators 1.1 and 1.2 are operated as an elevator group with a group control. The devices 30.1 and 30.2 can, however, also be operated independently of one another.

The program "P1.1" or "P1.2" can give different commands to the elevator control 15.1 or 15.2 for carrying out a test: for example, a car call, a floor call and/or a travel command. Different desired reactions of the elevator 1.1 or 1.2 are correspondingly taken into consideration: opening and closing of a shaft door of the elevator installation and/or opening and closing of a car door and/or travel of a car from one predetermined floor to another predetermined floor.

As indicated in FIG. 2, the processors P1 and P2 are connected by way of a communications connection 43 with a communications interface 33 for communication with a monitoring center 50. If it should be established during operation of the devices 30.1 and 30.2 that one of the elevators 1.1 and 1.2 is not available, then the processors P1 and P2 can communicate predetermined information to the monitoring center 50 by way of the communications connection 43 in order to indicate this situation.

Three variants of the method according to the present invention for automatic checking of the availability of an elevator installation in the case of the example of the elevator installation 1 are described in the following. The two first variants ("method A", "method B") refer to checking of a single elevator. The third variant ("method C") refers to a group of two elevators with a group control.

Method A

The method A is explained on the basis of an example for automatic checking of the availability of the elevator 1.1 with the help of the device 30.1.

With respect to the uses of the elevator 1.1, the starting point is a use model based on the following assumptions:

The starting point is that the elevator 1.1 is used in a sequence of successive time periods $\Delta T(i)$ each with the same duration $t_e(i)-t_0(i)$. The index $i(i \geqq 1)$ characterizes the respective time intervals, $t_0(i)$ denotes the point in time of the beginning of the time period $\Delta T(i)$, and $t_e(i)$ denotes the point in time of the end of the time period $\Delta T(i)$.

It is assumed that all uses take place under conditions which repeat in similar manner after the start of each individual one of the time periods $\Delta T(i)$. With this precondition it is to be expected that a use frequency of the elevator 1.1 shows in each of the time periods $\Delta T(i)$—apart from statistical fluctuations—the same course over time (referred to the beginning of the respective time period). For the sake of simplicity it is assumed that the end of a time period coincides with the beginning of the directly following time period, i.e. $t_e(i)=t_0(i+1)$.

A use model of that kind is, for example, realistic for an elevator installation in a public building. The number of visitors of such a building and thus the number of users of the elevator fluctuates on successively following days—caused by opening times, the habits of visitors, or the like—in each instance according to the same regularities as a function of time. In certain circumstances the number of users is additionally subject to fluctuations from day to day, which follow long-term trends, for example caused by seasonal influences.

Under the stated preconditions it can be assumed that an estimated value for the use frequency for a specific time period $\Delta T(n)$ can be obtained from measurement values for the use frequency for one or more earlier time periods $\Delta T(i)$, wherein $i<n$, by means of statistical methods.

According to method A, measurement values for the use frequency are determined as follows.

The starting point is a succession of uses of the elevator 1.1 which take place at the time points $t_B(k)$ after the beginning of the time period $\Delta T(i=1)$. The index k denotes the individual uses.

The uses of the elevator 1.1 and the respective time point $t_B(k)$ of a use are registered by means of the device 30.1 for times $t>t_0(i)$.

Measurement values $N_m(i, t)$ for a use frequency of the elevator 1.1 are determined for the times $t>t_0(i)$ as follows. Each time period $\Delta T(i)$, wherein $t_0(i)\leqq t\leqq t_e(i)$, is subdivided each time into a predetermined number of, for example, m time intervals $\delta T(i, j)$ of equal length d, wherein $\delta T(i, j)$ is defined as time period $$\delta T(i, j):\ t_0(i)+(j-1)d\leqq t\leqq t_0(i)+j\ d$$

wherein $d=(t_e(i)-t_0(i))/m$ and $j=1, \ldots, m$.

The number of uses which are registered in the time intervals $\delta T(i, j)$ are denoted by $N(i, j)$. The measurement value $N_m(i, t)$ for the use frequency is now defined according to $$N_m(i,t)=N(i,j)/d$$

$$\text{for } t_0(i)+(j-1)d\leqq t\leqq t_0(i)+j\ d$$

The measurement value $N_m(i, t)$ of the use frequency is accordingly determined as a quotient of the number of the uses registered during the time interval $\delta T(i, j)$ and the duration of the time interval $\delta T(i, j)$.

In the method A it is proposed to determine an estimated value $N_S(i, t)$ for the use frequency for a specific time period $\Delta T(i)$ from measurement values for the use frequency for the time period $\Delta T(k)$, wherein $k\leqq i$, preceding the time period $\Delta T(i)$.

Estimated values Ns can, for example, be iteratively ascertained according to the recursion formula (starting from i=1):

$$N_S(i+1,t)=N_s(i,\ t-\Delta(i))+[N_m(i,\ t-\Delta(i))-N_{S(i,\ t-\Delta(i))}]/\lambda=F(i,\ t,\lambda)$$

wherein $\Delta(i)=t_0(i+1)-t_0(i)$ indicates the time span between the beginning of the time period $\Delta T(i+1)$ and the beginning of the time period $\Delta T(i)$. In the present case it is assumed that $t_0(i+1)=t_e(i)$, i.e. $\Delta(i)=t_e(i)-t_0(i)=t_0(i+1)-t_0(i+1)$ corresponds with the duration of the time periods $\Delta T(i)$ or $\Delta T(i+1)$.

The lefthand side of the recursion formula defines estimated values of the use frequency as a function of the time for the time period $\Delta T(i)$. The righthand side considers estimated values and measurement values for the use frequency as a function of the time for the time period $\Delta T(i)$. The term $\Delta(i)$ on the righthand side of the recursion formula takes into consideration that the beginning of the time period $\Delta T(i+1)$ is displaced relative to the beginning of the time period $\Delta T(i)$ by the duration of the time period $\Delta T(i)$, i.e. by $\Delta(i)$, and that the method is based on the assumption that the use frequency in all time periods—referred to the beginning of the respective time periods—should have a similar path as a function of time (apart from statistical fluctuations which can occur over several successive time periods).

The function $F(i, t, \lambda)$ contains a parameter $\lambda$ which can be selected to be suitable for optimization purposes and determined empirically. For $\lambda=1$ there applies, for example, $F(i, t\ \lambda)=N_m(i, t-\Delta(i))$. In this case it is assumed that the use frequency measured for a time period $\Delta T(i)$ is equal to the estimated value for the use frequency for the following time period $\Delta T(i+1)$. In the boundary case $\lambda\rightarrow\infty$ there follows, thereagainst, $F(i, t\ \lambda)=N_S(i, t-\Delta(i))=N_S(i+1, t-\Delta(i))$. In this case the estimated values for the use frequency were thus independent of the index i, i.e. identical for all time periods $\Delta T(i)$. In this case the measurement values $N_m(i, t)$ have, for the use frequency, no influence on the size of the corresponding estimated values. The parameter $\lambda$ in the function $F(i, t\ \lambda)$ accordingly determines by which weighting a measurement value $N_m(i, t)$ for a time interval $\Delta T(i)$ influences, by comparison with estimated values of the use frequency for the time period $\Delta T(k)$, wherein $k\leqq i$, the estimated value for the use frequency $N_s(i+1, t)$ for the following time period $\Delta T(i+1)$.

In other words: by means of an iteration according to the recursion formula $F(i, t\ \lambda)$, the estimated values for the use frequency for successively following time periods can be adapted to current trends which manifest themselves in the time dependence of the measurement values for the use frequency in the course of several successive time periods $\Delta T(k)$, wherein $k\leqq i$.

The above iteration can be commenced with starting values for $N_S(i=1, t)$ which can be selected as desired. In the case of a repeated use of the iteration according to the function $N_S(i+1, t)=F(i, t\ \lambda)$ the estimated values, which are calculated in that manner, for the use frequency converge with greater or less rapidity towards realistic values which correspond with a statistic expectation value for the use frequency according to a statistical analysis of uses of the elevator 1.1. The speed of the convergence depends on the selection of the parameter $\lambda$. The parameter $\lambda$ accordingly determines inter alia how quickly the device 30.1 in operation of the elevator 1.1 can determine realistic data for uses of the elevator 1.1 on the basis of the method A. In the course of the convergence of the iteration the device 30.1 thus runs through a 'learning phase', during which it can collect and evaluate data about uses of the elevator 1.1.

The above parameter $\lambda$ can additionally be optimized according to the criterion that the device 30.1 in operation gives, on the basis of the method A, as few as possible commands for carrying out a test of the elevator 1.1.

It is obvious that instead of the iteration according to the function $N_S(i+1, t)=F(i, t\ \lambda)$ also another statistical methods can be used in order to obtain realistic estimated values for the use frequency.

The method A is explained in the following on the basis of FIGS. 3 and 4.

Figure 3:
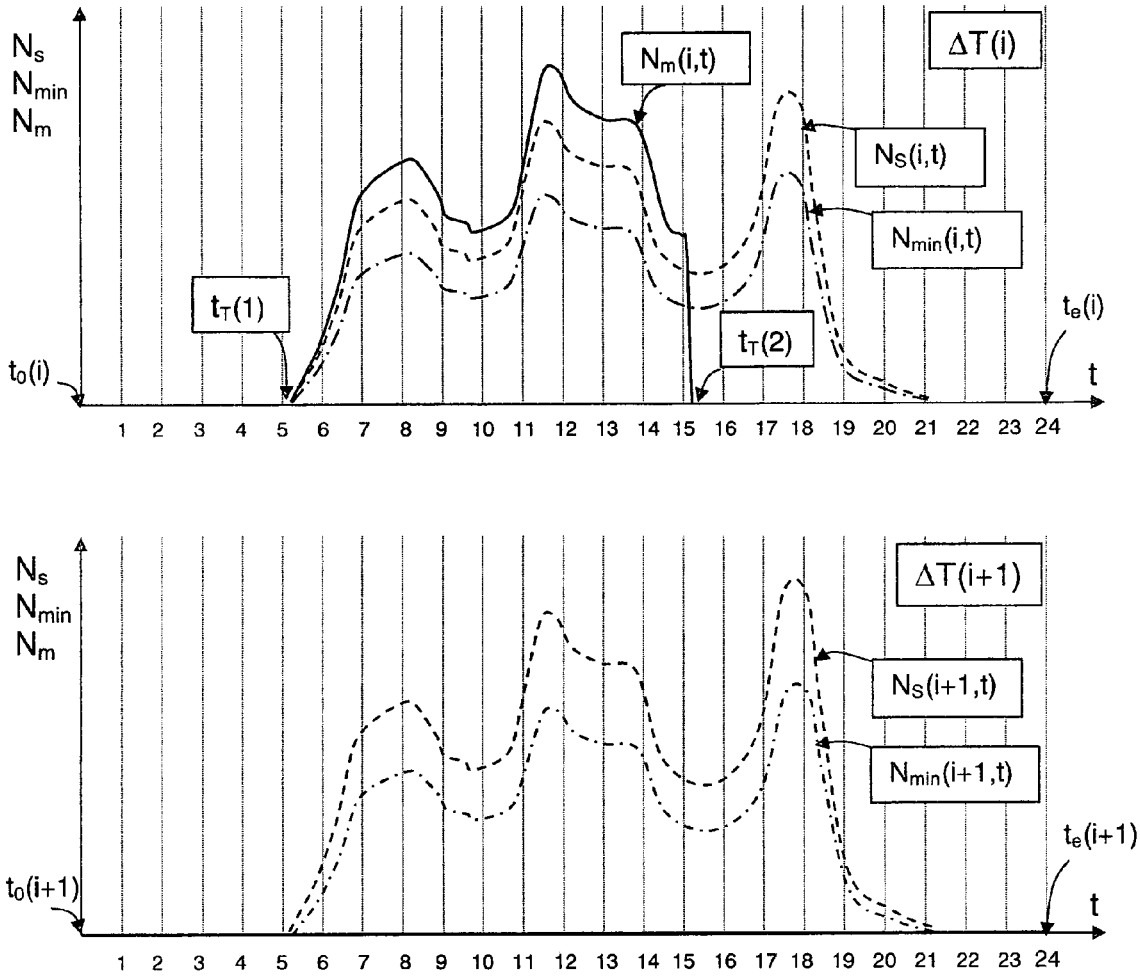
FIG. 3 is a plot of estimated values and measurement values for a use frequency of an elevator as a function of time for different time periods.

FIG. 3 shows (arranged one above the other) two diagrams respectively as a function of time t. The upper diagram is associated with a time period $\Delta T(i)$ and the lower diagram is associated with the time period $\Delta T(i+1)$. The end of the time period $\Delta T(i)$ coincides with the beginning of the time period $\Delta T(i+1)$, i.e. $t_e(i)=t_0(i+1)$.

The diagrams illustrate data for estimated values $N_S$ and measurement values $N_m$ and minimum values $N_{min}$, which are filed in the memories M12, M13 and M14. These data are detected, managed and analyzed during run-down of the program "P1.1".

The upper diagram in FIG. 3 shows an estimated value $N_S(i, t)$ for the use frequency of the elevator 1.1, a corresponding measurement value $N_m(i, t)$ for the use frequency and a minimum value $N_{min}(i, t)$ for the use frequency. The lower diagram in FIG. 3 shows an estimated value $N_S(i+1, t)$ for the use frequency of the elevator 1.1 and a minimum value $N_{min}(i+1, t)$ for the use frequency.

The time axes of the diagrams comprise a division in each instance into 24 hours. The diagrams signify, for example, that the elevator 1.1 is usually used only between 5 hours and 21 hours. The estimated values $N_S(i, t)$ and $N_S(i+1, t)$ are in the time between 21 hours in the evening and five hours in the morning equal to 0. According to the path of the curves $N_S(i, t)$ and $N_S(i+1, t)$ temporary peak values of the use frequency are expected between 5 hours and 21 hours each time in the morning.

The diagrams in FIG. 3 illustrate the estimated values Ns, measurement values $N_m$ and minimum values $N_{min}$ for a time point around 16 hours during the time period $\Delta T(i)$. According to FIG. 3 it is assumed that the measurement values $N_m$ adopt the value 0 closely above 15 hours. In the time between 15 hours and 16 hours measurement values for $N_m$ are accordingly detected, but no uses of the elevator 1.1 have been registered. Still no measurement values $N_m$ have been detected for the time from 16 hours in the time period $\Delta T(i)$.

Figure 4:
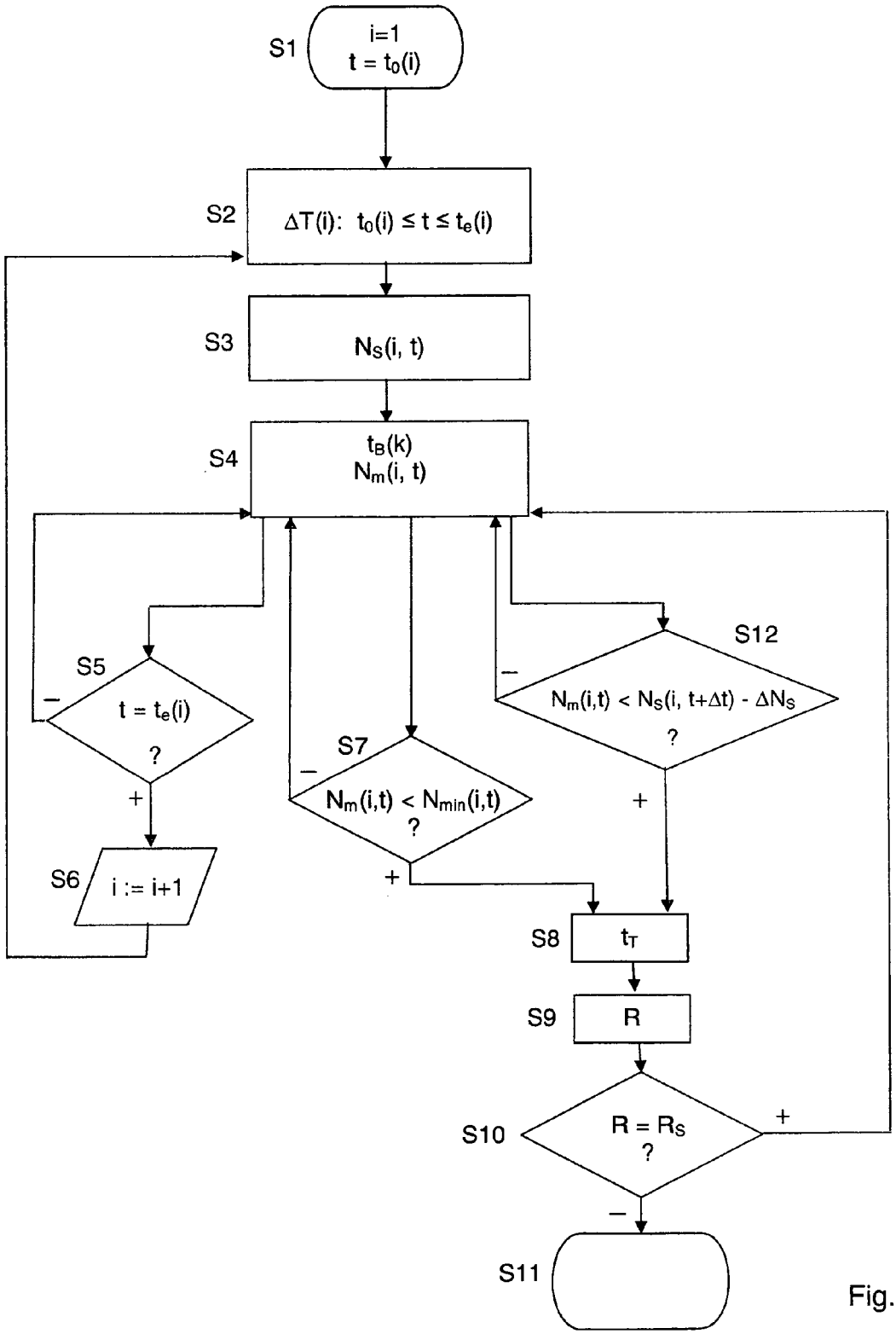
FIG. 4 is a flow chart for an embodiment of a method according to the present invention which is usable on the estimated values or the measurement values according to FIG. 3.

FIG. 4 illustrates the steps of the method A in the form of a flow chart with the method steps S1-S12.

In the method step S1 the device 30.1 is initialized: the processor P1 sets an internal counter i to i=1 and an internal clock to the time $t=t_0(i)$, i.e. the beginning of the time period $\Delta T(i)$. The program "P1.1" is started. Subsequently, there is continuation with the step S2.

In the method step S2 the time period $\Delta T(i)$, wherein $t_0(i) \leqq t \leqq t_e(i)$, is established in which the availability of the elevator 1.1 is to be checked. Subsequently, there is continuation with the step S3.

In the method step S3 the estimated values $N_S(i, t)$ for the use frequency of the elevator 1.1 for the time period $\Delta T(i)$ are loaded from the memory M12 into the processor P1.

In the method step S4 uses of the elevator 1.1 and the respective time point $t_B(k)$ of each use (index k) are registered and the measurement values $N_m(i, t)$ for the use frequency are ascertained as function of time during the time period $\Delta T(i)$ and filed in the memory M13. Estimated values $N_s(i+1, t)$ can be calculated from the measurement values $N_m(i, t)$ and estimated values $N_s(k, t)$, wherein $k \leqq i$, for example according to the above-mentioned iteration $N_s(i+1, t)=F(1, t, \lambda)$ and subsequently filed in the memory M12.

The method steps S5, S7 and S12 run parallel to the method step S4.

In the method step S5 the processor P1 checks whether the end of the time period $\Delta T(i)$, wherein $t_0(i) \leqq t \leqq t_e(i)$, has been reached. If so, then continuation is with the method step S6 (path +). If no, continuation is with the method step S4 (path −).

In the method step S6 the index i is increased by 1. Subsequently the preceding steps from S2 are repeated.

In the method step S7 it is checked whether the measurement value $N_m(i, t)$ for the use frequency of the elevator falls below the minimum value $N_{min}(i, t)$. $N_{min}(i, t)$ is smaller than the estimated value $N_s(i+1, t)$ by a predetermined amount, as indicated in FIG. 3. If the measurement value $N_m(i, t)$ for the use frequency of the elevator falls below the minimum value $N_{min}(i, t)$ then continuation is with the method step S8 (path +). If no, then continuation is with the method step S4 (path −).

In the method step S8 a command for carrying out a test of the elevator 1.1 is given (at time point $t_T$) to the elevator control 15.1. Subsequently, continuation is with the method step S9.

In the method step S9 a reaction R of the elevator 1.1 is registered.

Subsequently, in the method step S10 the reaction R is compared with a desired reaction $R_S$. If the reaction R corresponds with the desired reaction $R_S$, then it can be assumed that the elevator 1.1 is available. In this case continuation can be with the step S4 (path +). If the reaction R does not correspond with the desired reaction $R_S$, then it can be assumed that the elevator 1.1 is not available. In this case continuation can be with the step S1 (path −).

In the method step S11 it is communicated to the monitoring center 50 that the elevator 1.1 is not available. Subsequently, the method is interrupted. When the elevator 1.1 is available again then the method can be continued with the method step S1.

In the method step S12 it is checked whether it is to be expected that—starting from an instant t—a rise of the use frequency by more than a predetermined amount $\Delta N_s$ is expected within a time period $\Delta t$, i.e. $(N_m(t)<N_S(t+\Delta t)-\Delta N_S)$. If a rise by more than $\Delta N_S$ is expected, then as a precaution a command for carrying out a test according to the method step S8 is given (path +). If the latter is not the case, then continuation is with the step S4 (path −).

As is indicated in FIG. 3, a command for carrying out a test was given to the elevator control 15.1 once in each of the method steps S7 and S12. A first test at the time point $t_T(1)$ is to be attributed to the method step S12. In this case, it was successfully checked shortly before a strong rise in use frequency in the morning that the elevator is available.

A second test at the time point $t_T(2)$ is to be attributed to the method step S7. In this case it was checked shortly after a strong decrease in use frequency below the minimum value $N_{min}(i, t)$ towards 15 hours whether the elevator 1.1 is available. The result is negative. The use frequency $N_m(t)$ remains, for $t>t_T(2)$, equal to 0 because the elevator 1.1 is not available.

The values for $N_S(i+1, t)$ for the use frequency and the minimum value $N_{min}(i+1, t)$ in the lower diagram of FIG. 3 are calculated from the values $N_S(i, t)$ and $N_m(i, t)$ for the time period $\Delta T(i)$ according to the iteration $N_s(i+1, t)=F(1, t, \lambda)$. $N_S(i+1, t)=N_S(i+1, t)=N_S(i, t-\Delta(i))$ was set for $t>t_T(2)+\Delta(i)$ since for this region no corresponding measurement values of the use frequency in the time period $\Delta T(i)$ were registered ($N_m(t)=0$ for $t>t_T(2)$ in the time period $\Delta T(i)$, see above).

Obviously, respective values which are greater than, equal to or smaller than the respective estimated values $N_S(i, t)$ for the time period $\Delta T(i)$ result for the estimated values $N_S(i+1, t)$ for the time period $\Delta T(i+1)$ respectively depending on whether the measurement values $N_m(i, t)$ are greater than, equal to or smaller than the corresponding estimated values $N_S(i, t)$ ($\lambda>0$ presumed).

The method A can be so organized that the test according to the method step S8 is not carried out at a predetermined time interval, for example when the elevator 1.1 is not used or only little used, for example during a night.

Method B

Method B is explained on the basis of an example for an automatic checking of the availability of the elevator 1.1 with the help of the device 30.1.

The method B is based on the following measures:

1) on an observation of the operation of the elevator 1.1 and in a given case on the registration of uses of the elevator 1.1 (insofar as present) and a determination of the respective time point $t_B$ of a use with the help of the device 30.1;

2) on a determination of the time spacing of two successively following uses; and 3) on an estimation of the time point at which the next use is to be expected after the last registered use.

Measure 3) corresponds with the estimation of a time spacing between the last registered use and the next use to be expected. The reciprocal value of this estimated time spacing corresponds with an estimated value for the use frequency for a time period which directly follows the last registered use.

In performance of the method B the above measures 1)-3) are carried out one after the other and subsequently repeated. If no further use of the elevator 1.1 is established up to the point in time estimated in measure 3), then it can be presumed that the elevator 1.1 is not available. According to method B under this condition a command for carrying out a test is given to the elevator control 15.1 by the device 30.1 and it is checked whether the elevator 1.1 exhibits a reaction corresponding with expectations.

Figure 5:
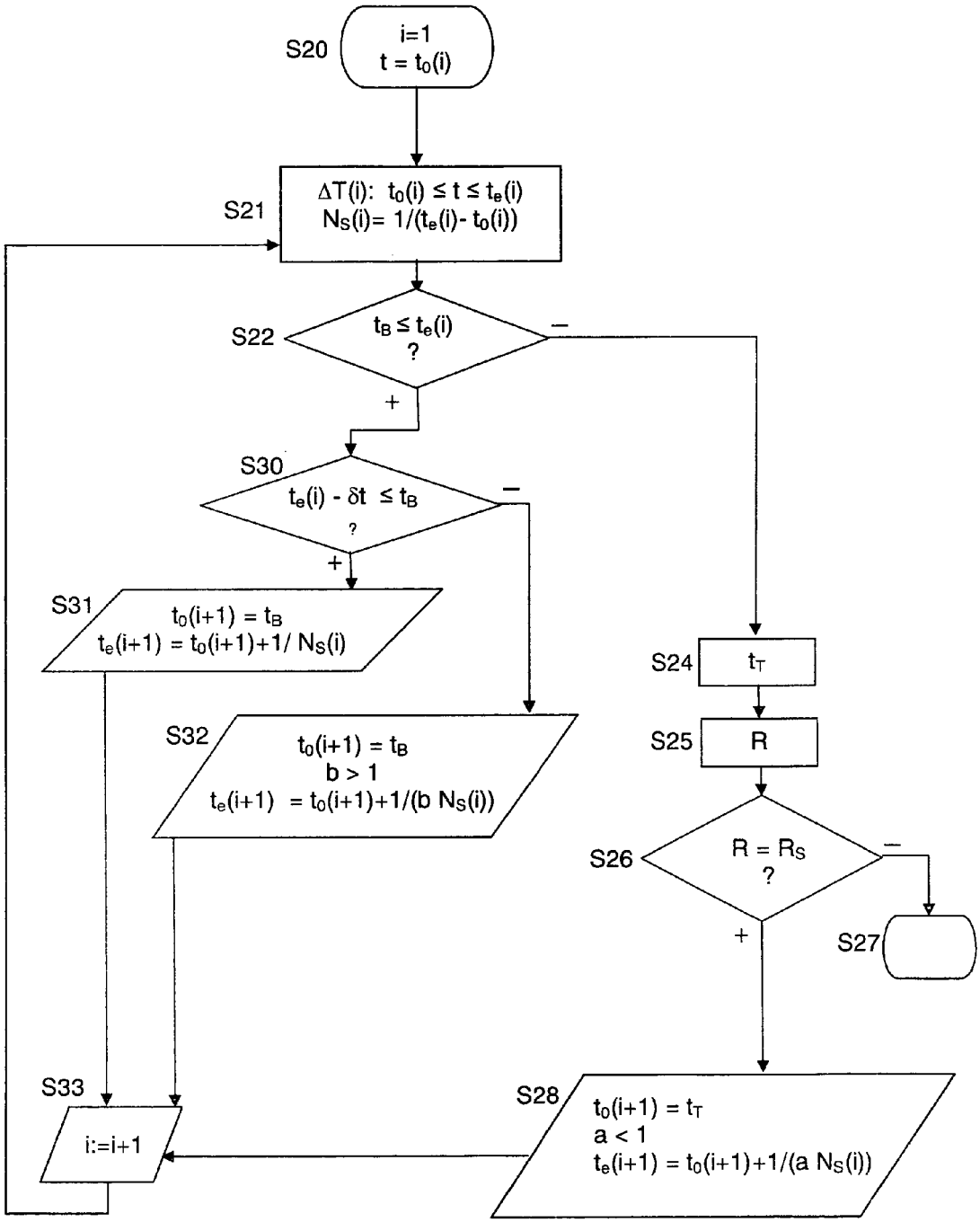
FIG. 5 is a flow chart for a further form of embodiment of the method according to the present invention.

FIG. 5 illustrates the steps of the method B in the form of a flow chart with method steps S20-S33.

In the method step S20 the device 30.1 is initialized: the processor P1 sets an internal counter i to i=1 and an internal clock to the time $t=t_0(i)$. The program "P1.1" is started. Subsequently, continuation is with the method step S21.

In the method step S21 a time period $\Delta T(i)$, wherein $t_0(i) \leqq t \leqq t_e(i)$, is established. The reciprocal value of the duration can be regarded as estimated value $N_S(i)$ for the use frequency for the time period $\Delta T(i)$, i.e. $N_S(i)=1/[t_e(i)-t_0(i)]$. On initialization of the method (i=1) according to the method step S20 the timer period $\Delta T(i)$ can be predetermined as desired, particularly since the device at the beginning of the method does not have any data with respect to the uses of the elevator 1.1. The above magnitude $N_S(i)$ can accordingly show, at the beginning of the method, deviations of whatever size from the measurement values for the use frequency.

In the following the method step S22 it is checked whether in the time period $\Delta T(i)$ a use of the elevator takes place. If up to the end of this time period, i.e. before the time point $t_e(i)$, no use of the elevator takes place, continuation is with the method step S24. If a use takes place up to time point $t_e(i)$, then the time point $t_B$ of the use is registered and continuation is with the method step S30.

In the method step S24 a command for carrying out a test of the elevator 1.1 is given to the elevator control 15.1 (at time point $t_T$). Subsequently, continuation is with the method step S25.

In the method step S25 a reaction R of the elevator 1.1 is registered.

Subsequently, in the method step S26 the reaction R is compared with a desired reaction $R_S$. If the reaction R does not correspond with the desired reaction $R_S$, then it can be assumed that the elevator 1.1 is not available. In this case continuation can be with the method step S27 (path −). If the reaction R corresponds with the desired reaction $R_S$, then it can be assumed that the elevator 1.1 is available. In this case the starting point can be that the estimated value $N_S(i)$ defined according to the method step S21 is too large by comparison with the use frequency in actual operation. The method can be continued with the method step S28 (path +).

In the method step S27 it is communicated to the monitoring center 50 that the elevator 1.1 is not available. Subsequently, the method is interrupted. If the elevator 1.1 is still available, then the method can be continued with the method step S20.

Method step S28: According to the method step 26 there is a reason for the assumption that the estimated value $N_S(i)$ for the use frequency is too large by comparison with the use frequency of the elevator in actual operation. It is assumed that a realistic estimated value for the use frequency would be smaller by a factor a <1 than the above value $N_S(i)$. This assumption is checked in a following iteration step. Initially the beginning and end of a time period $\Delta T(i+1)$, wherein $t_0(i+1) \leqq t \leqq t_e(i+1)$, following the time period $\Delta T(i)$ are established. The beginning of the time period $\Delta T(i+1)$ is set at the time point $t_T$ of the test according to the method step S24 and the end of the time period $\Delta T(i+1)$ is determined according to the assumption that a realistic value for the use frequency is given by the magnitude "a $N_S(i)$":

$$t_0(i+1)=t_T$$

$$t_e(i+1)=t_0(i+1)+1/[a\ N_S(i)]$$

Subsequently the method is continued with the method step S33.

In the method step S30 it is checked whether the time point $t_B$ of the use lies in a time interval of the duration $\delta t$ at the end of the time period $\Delta T(i)$, i.e. it is checked whether the condition $t_e(i)-\delta t \leqq t_B \leqq t_e(i)$ is fulfilled. If yes, then the method is continued with the method step S31 (path +). If no, then continuation is with the method step S32 (path −). The duration $\delta t$ can be changed in dependence on the duration of the time period $\Delta T(i)$, for example in such a manner that $\delta t$ is always smaller than a specific fraction of the difference $t_e(i)-t_0(i)$. This in the course of the iteration leads to a dynamic adaptation of the method to changed conditions, for example when the use frequency of the elevator strongly varies in the course of time.

In the method step S31 it is assumed that the estimated value $N_S(i)$, which was specified in the method step S21, for the use frequency corresponds with the use frequency of the elevator in actual operation. This assumption is checked in the next iteration step. Initially the beginning and end of a time period $\Delta T(i+1)$, wherein $t_0(i+1) \leqq t \leqq t_e(i+1)$, following the time period $\Delta T(i)$ are established. The beginning of the time period $\Delta T(i+1)$ is set at the time point $t_B$ of the last registered use according to the method step S22 and the end of the time period $\Delta T(i+1)$ is determined according to the assumption that a realistic value for the use frequency is given by the magnitude $N_S(i)$:

$$t_0(i+1)=t_B$$

$$t_e(i+1)=t_0(i+1)+1/N_S(i)$$

Subsequently, the method is continued with the method step S33.

In the method step S32 it is assumed that the estimated value $N_S(i)$ for the use frequency is too small in comparison with the use frequency of the elevator in actual operation.

This assumption is checked in the next iteration step. Initially the beginning and end of a time period ΔT(i+1), wherein $t_0(i+1) \leqq t \leqq t_e(i+1)$, following the time period ΔT(i) are established. The beginning of the time period ΔT(i+1) is set at the time point $t_B$ of the last registered use according to the method step S22 and the end of the time period ΔT(i+1) is determined according to the assumption that a realistic value for the use frequency is given by the magnitude "b $N_S$(i)", wherein b>1:

$$t_0(i+1)=t_B$$

$$t_e(i+1)=t_0(i+1)+1/[b\ N_S(i)],$$

Subsequently, the method is continued with the method step S33.

In the method step S33 the index i is increased by 1. Subsequently the foregoing steps from the method step S21 are repeated.

With suitable selection of the parameters δt, a and b the magnitude $N_S$(i) converges, with repeated use of the method steps S21 to S33, more or less rapidly towards the use frequency of the elevator in actual operation. Rapid changes in the use frequency as a function of time can be quickly recognized during running of the method steps S21 to S32. A test according to the method step S24 is caused only when a next anticipated use does not appear for an unexpectedly long time (method step S22).

A further advantage of the method B is to be seen in that the processor P1 in each iteration step has to consider only a small amount of data: during an iteration step merely three different time points have to be considered (beginning and end of the time period ΔT(i) according to the method step S21 and the time point $T_B$ of the last use). Moreover, by contrast to method step A, no statistical data for uses over long periods of time have to be detected and stored. Accordingly, for carrying out the method B less memory space is needed (this relates to the memories M12, M13, M22 and M23 of the device 30). Moreover, the processor needs less computing time.

The method B can be so organized that the test according to the method step S24 is not carried out at a predetermined time interval, for example if the elevator 1.1 is not used or is only little used, for example during a night.

Method C

The elevators 1.1 and 1.2 of the elevator installation 1 can also be operated as an elevator group with a group control. For realization of the group control it is provided that the elevator controls 15.1 and 15.2 can communicate by way of the communications connection 18.

As previously mentioned, the device 30.1 for checking the availability of the elevator 1.1 and the device 30.2 for checking the availability of the elevator 1.2 are designed to co-operate with one another. For this purpose the communications connection 35 is provided between the processors P1 and P2 (FIG. 2). The processors P1 and P2 can exchange data by way of the communications connection 35.

The device 30.1 can in operation register exclusively uses of the elevator 1.1 and ascertain estimated values $N_S$(1) and measurement values $N_m$(1) for the use frequency of this elevator and store these values in the memories M12 and M13.

Correspondingly, the device 30.2 in operation can register exclusively uses of the elevator 1.2 and ascertain estimated values $N_S$(2) and measurement values $N_m$(2) for the use frequency of this elevator and store these values in the memories M22 and M23.

The co-operation of the devices 30.1 and 30.2 expands the functional scope of the device 30 in the case of a group control for the elevators 1.1 and 1.2.

On the one hand, the estimated values $N_S$(1) and measured values $N_m$(1), which are ascertained for the elevator 1.1, for the use frequency are evaluated by the device 30.1 according to one of the methods A and B. In this case a decision about whether a command for carrying out a test shall be given to the elevator control 15.1 does not depend on data about the use of the elevator 1.2.

Equally, the estimated values $N_S$(2) and measured values $N_m$(2), which are ascertained for the elevator 1.2, for the use frequency are evaluated by the device 30.2 according to one of the methods A and B. In this case a decision about whether a command for carrying out a test shall be given to the elevator control 15.2 does not depend on data about the use of the elevator 1.1.

As a rule, all elevators of an elevator group are uniformly loaded in correspondence with their transport capacity. Elevators of the same capacity should accordingly be used for the same frequency (in the statistical mean) insofar as they are available.

Accordingly, it is proposed for checking the availability of the elevator 1.1 in the scope of the method according to the present invention to also include measurement values for the use frequency of the elevator 1.2 in a decision whether a command for carrying out a test of the elevator 1.1 shall be given. Correspondingly, for checking the availability of the elevator 1.2 in the scope of the method according to the invention also values for the use frequency of the elevator 1.1 can be included.

If the measured values $N_m$(1) for the use frequency of the elevator 1.1 should be substantially smaller than the measured value $N_m$(2) for the use frequency of the elevator 1.2 then this can be a reason for assumption that the elevator 1.1 is not available. This can be checked by means of the device 30 in that the device 30.1 compares the measured values $N_m$(1) and $N_m$(2) and, if the measured value $N_m$(1) is smaller than the measured value $N_m$(2) by a predetermined amount, gives to the elevator control 15.1 a command for carrying out a test of the elevator 1.1. The same applies to checking the availability of the elevator 1.2.

Method C comprises—in a generalization of this approach—the steps:

In an elevator installation with several elevators, measured values for the use frequency of the elevators are determined.

If the measured value of the use frequency of one of the elevators is smaller than the mean value of the measured values for the use frequencies of the other elevators by a predetermined amount then a command for carrying out at least one test of the elevator installation is given.

Subsequently a reaction of the elevator installation is registered and compared with a desired reaction.

In a variant of this method it is provided that the command is so selected that the desired reaction comprises a change in state of one elevator. The state change can be registered automatically. The test can comprise, for example, a floor call and/or a car call.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of automatically checking availability of an elevator installation having at least one elevator comprising the steps of:

a. generating to the elevator installation at least one predetermined command for carrying out at least one test of the elevator installation;

b. registering at least one reaction of the elevator installation to the at least one predetermined command;

c. comparing the at least one reaction with a desired reaction of the elevator installation, wherein the test in the case of availability of the elevator installation leads to the desired reaction;

d. ascertaining at least one of a first estimated value for a use frequency of the elevator for a first time period and a second estimated value for the use frequency for a second time period, wherein the second time period begins at a later instant than the first time period;

e. determining a measurement value for the use frequency for the first time period;

f. comparing the measurement value with at least one of the estimated values; and g. generating the command for carrying out the test when the measurement value is smaller than the compared estimated value by a predetermined amount.

2. The method according to claim 1 wherein at least one of each reaction and use of the elevator is registered by one of a registration of an actuation of a car door, a registration of an actuation of a shaft door, a registration of a change in state of a drive of the elevator installation, a registration of an actuation of a brake, a registration of signals for control of components of the elevator installation and a detection of the position of a car of the elevator installation.

3. The method according to claim 1 wherein one of a duration of a time interval is predetermined and a number of uses of the elevator registered during the time interval is determined and that a number of uses of the elevator is predetermined and a duration of a time interval in which these uses are registered is determined, and wherein the measurement value is calculated from the respective number and the respective duration.

4. The method according to claim 1 wherein that the first estimated value and the measurement value for the first time period are determined and the second estimated value for the second time period is set to a value which is one of:

(i) the same as the first estimated value if the first estimated value and the measurement value differ by not more than a predetermined amount;

(ii) smaller than the first estimated value if the measurement value is smaller than the first estimated value by more than the predetermined amount; and (iii) greater than the first estimated value if the measurement value is greater than the first estimated value by more than the predetermined amount.

5. The method according to claim 1 wherein the command for carrying out at least one test of the elevator installation is one of a car call, a memory call and a travel command.

6. The method according to claim 1 wherein the desired reaction is one of opening and closing a shaft door, opening and closing a car door and a travel of a car from one predetermined floor to another predetermined floor.

7. The method according to claim 1 wherein if the reaction of the elevator installation does not correspond with the desired reaction a predetermined information is communicated to a monitoring center.

8. A device for automatic checking of the availability of a elevator installation having an elevator control for at least one elevator comprising:

a command transmitter by which a predetermined command for carrying out at least one test of the elevator installation can be given to the elevator control, wherein the test is so selected that in the case of availability of the elevator installation a desired reaction of the elevator installation can be registered;

a registration device for registration of the reaction, which follows the command, of the elevator installation; and a device for comparing the reaction with the desired reaction, said device including a means for determining at least one of a first estimated value for a use frequency of the elevator for a first time period and a second estimated value for the use frequency for a second time period, a measuring device for determining a measurement value for the use frequency for the first time period and a control device for controlling said command transmitter in such a manner that the command is given when the measurement value is smaller than one of the respective estimated values by a predetermined amount.

9. The device according to claim 8 wherein said registration device is one of a device for registering an actuation of a car door, a device for registering an actuation of a shaft door, a device for registering a change in state of a drive of the elevator installation, a device for registering an actuation of a brake, a device for registering signals for control of components of the elevator installation and a device for detecting a position of the car of the elevator.

10. The device according to claim 8 wherein said measuring device is a device for detecting a position of the car of the elevator.

11. The device according to claim 8 including a communications connection for communicating a predetermined information to a monitoring center for the case that the reaction does not correspond with the desired reaction.

* * * * *